US010988967B2

(12) United States Patent
Toll et al.

(10) Patent No.: US 10,988,967 B2
(45) Date of Patent: Apr. 27, 2021

(54) DOOR KITS AND RELATED METHODS

(71) Applicant: Masonite Corporation, Tampa, FL (US)

(72) Inventors: David Toll, Cumming, GA (US); Roldan Vazquez, St. Charles, IL (US)

(73) Assignee: Masonite Corporation, Tampa, FL (US)

( * ) Notice: Subject to any disclaimer, the term of this patent is extended or adjusted under 35 U.S.C. 154(b) by 0 days.

(21) Appl. No.: 16/688,323

(22) Filed: Nov. 19, 2019

(65) Prior Publication Data

US 2020/0087974 A1 Mar. 19, 2020

Related U.S. Application Data

(63) Continuation of application No. 15/614,833, filed on Jun. 6, 2017, now Pat. No. 10,480,240.

(60) Provisional application No. 62/347,312, filed on Jun. 8, 2016.

(51) Int. Cl.

| | |
|---|---|
| ***E06B 1/52*** | (2006.01) |
| ***E06B 3/70*** | (2006.01) |
| ***E06B 3/36*** | (2006.01) |

(52) U.S. Cl.

CPC ..... *E06B 1/52* (2013.01); *E06B 3/36* (2013.01); *E06B 3/70* (2013.01)

(58) Field of Classification Search

CPC ..... E06B 1/52; E06B 1/10; E06B 1/08; E06B 3/70; E06B 3/36

See application file for complete search history.

(56) References Cited

U.S. PATENT DOCUMENTS

| | | | | | |
|---|---|---|---|---|---|
| 2,742,146 | A * | 4/1956 | Lester, Jr. | B65D 81/057 | 206/325 |
| 2,929,495 | A * | 3/1960 | Simonsen | B65D 85/70 | 206/325 |
| 2,997,750 | A * | 8/1961 | Lester, Jr. | E06B 1/52 | 52/212 |
| 3,111,724 | A * | 11/1963 | Piekarski | E06B 1/10 | 206/325 |
| 3,222,833 | A * | 12/1965 | Woodrum | E06B 3/9885 | 52/211 |
| 3,545,135 | A * | 12/1970 | Lieber | E06B 1/30 | 49/505 |
| 3,707,057 | A * | 12/1972 | Frydenberg | E06B 1/32 | 49/505 |

(Continued)

*Primary Examiner* — Justin B Rephann

(74) *Attorney, Agent, or Firm* — Berenato & White, LLC

(57) ABSTRACT

A door unit in kit form includes a partially preassembled split doorjamb assembly, a door, and extensions. The partially preassembled split doorjamb assembly includes first and second side bases substantially parallel to one another and a header base substantially perpendicular to and interconnecting the first and second side bases. The door is arranged within a space defined by the first and second side bases and the header base of the partially preassembled split doorjamb assembly so that the door, the first and second side bases, and the header base collectively establish a cavity. The first and second side extensions and a header extension are unassembled with respect to and connectable lengthwise to the first and second side bases and the header base, respectively. The extensions may be stowed within the cavity and/or stored on outer surfaces of the bases.

20 Claims, 10 Drawing Sheets

(56) References Cited

U.S. PATENT DOCUMENTS 4,019,303 A * 4/1977 McAllister ..... E06B 1/10 52/745.16
5,365,708 A * 11/1994 Winston ..... E06B 1/10 49/504
5,740,631 A * 4/1998 Mori ..... E06B 1/56 206/325
5,809,698 A * 9/1998 Mori ..... E06B 7/00 49/380
5,832,670 A * 11/1998 Bennett ..... E05D 7/02 49/382
5,974,745 A * 11/1999 Barr ..... E06B 1/10 49/504
6,029,410 A * 2/2000 Westberg, II ..... E06B 7/00 206/325
6,729,095 B2 * 5/2004 Wang Chen ..... E06B 3/5892 49/501
7,748,527 B2 * 7/2010 Wisecarver ..... B65D 5/5069 206/321
2003/0005652 A1 * 1/2003 Hagel ..... E06B 1/06 52/211
2006/0150524 A1 * 7/2006 Kibbel ..... E06B 1/526 49/501
2007/0022699 A1 * 2/2007 Wang ..... E06B 1/30 52/656.4
2008/0178553 A1 * 7/2008 Micho ..... E06B 1/06 52/656.4
2008/0222979 A1 * 9/2008 Rissmiller ..... E06B 1/60 52/213
2010/0212239 A1 * 8/2010 Wang ..... E06B 1/20 52/217
2014/0102017 A1 * 4/2014 Booi ..... E06B 1/52 52/204.1
2015/0075109 A1 * 3/2015 Bergevin ..... E06B 1/36 52/656.2
2016/0258204 A1 * 9/2016 Poniros ..... E06B 1/6015

* cited by examiner

DOOR KITS AND RELATED METHODS

CROSS-REFERENCE TO RELATED APPLICATION AND CLAIM OF PRIORITY

This application is a continuation of U.S. patent application Ser. No. 15/614,833, filed Jun. 6, 2017, now U.S. Pat. No. 10,480,240, which claims the benefit of priority of U.S. Provisional Application No. 62/347,312 filed Jun. 8, 2016, the complete disclosure of which is incorporated herein by reference.

FIELD OF THE INVENTION

This invention relates to pre-hung doors and to related methods, including methods of packaging and installing the doors.

BACKGROUND

Preassembled doors, especially pre-hung doors, have become increasingly popular in commercial and residential settings due to their relative ease of installation. Generally, a preassembled door contains a door and a preassembled doorjamb assembly. In the case of a pre-hung door, one side edge of the door is pivotally connected, typically using two or more hinges, to a first side jamb of the doorjamb assembly, and optionally the other side edge of the door has a lockset that engages a strike plate and/or opening of a second side jamb of the doorjamb assembly. To install the preassembled door, the doorjamb assembly is placed in an opening of a wall frame, such as of a commercial or residential building, and plumbed and shimmed according to known techniques before being fastened in place to the frame.

A problem identified by Applicant with respect to preassembled doors is the high costs involved in transporting and delivering the doors and the associated pieces to a wholesaler, retailer, and/or installation site. For example, the relatively large thickness of the preassembled doors limits the number of doors that may be stacked upon or positioned adjacent one another within a given space, such as on the flatbed of a tractor trailer. Many wholesalers and retailers do not have sufficient storage space to maintain a large inventory of preassembled doors. Further, trim pieces and frame components typically are shipped in a cardboard carton, which may become lost, separated from the pre-hung door, and/or damaged during transit.

SUMMARY OF THE INVENTION

A first aspect of the invention provides a pre-hung door unit in kit form that includes a partially preassembled split doorjamb assembly and a door. The partially preassembled split doorjamb assembly includes first and second side bases substantially parallel to one another, a header base substantially perpendicular to and interconnecting the first and second side bases, and extensions. The door is arranged within a space defined by the first and second side bases and the header base of the partially preassembled split doorjamb assembly so that the door, the first and second side bases, and the header base collectively establish a cavity. The extensions include first and second side extensions and a header extension that are unassembled with respect to and connectable lengthwise to the first and second side bases and the header base, respectively. The extensions are stowed within the cavity of the door kit.

A second aspect of the invention provides a method of packaging a pre-hung door unit in kit form. The method involves providing a partially preassembled split doorjamb assembly including first and second side bases substantially parallel to one another, a header base substantially perpendicular to and interconnecting the first and second side bases, and extensions, arranging a door within a space defined by the first and second side bases and the header base of the partially preassembled split doorjamb assembly so that the door, the first and second side bases, and the header base collectively establish a cavity, and stowing the extensions in the cavity. The extensions include first and second side extensions and a header extension that are unassembled with respect to and connectable lengthwise to the first and second side bases and the header base, respectively.

A third aspect of the invention provides a method of installing a pre-hung door unit shipped in kit form. The method involves providing a pre-hung door shipped in kit form including a partially preassembled split doorjamb assembly having first and second side bases substantially parallel to one another and a header base substantially perpendicular to and interconnecting the first and second side bases, a door arranged within a space defined by the first and second side bases and the header base of the partially preassembled split doorjamb assembly so that the door, the first and second side bases, and the header base collectively establish a cavity. The partially preassembled split doorjamb assembly further includes extensions stowed within the cavity. The stowed extensions include first and second side extensions and a header extension that are unassembled with respect to and connectable lengthwise to the first and second side bases and the header base, respectively. According to the method, the extensions are removed from the cavity, the partially preassembled split doorjamb assembly is inserted into an opening of a wall doorframe and secured to the wall doorframe, and the first and second side extensions and the header extension are connected lengthwise to the first and second side bases and the header base, respectively.

A fourth aspect of the invention provides a door unit in kit form, including a partially preassembled split doorjamb assembly and a door. The partially preassembled split doorjamb assembly includes first and second side bases substantially parallel to one another, a header base substantially perpendicular to and interconnecting the first and second side bases, and extensions. The door is arranged within a space defined by the first and second side bases and the header base of the partially preassembled split doorjamb assembly so that the door, the first and second side bases, and the header base collectively establish a cavity. The extensions include first and second side extensions and a header extension that are connectable lengthwise to the first and second side bases and the header base, respectively. The first and second side extensions and the header extension are removably secured adjacent to outer surfaces of the bases.

According to a fifth aspect of the invention, a method is provided of packaging a door unit in kit form. The method involves providing a partially preassembled split doorjamb assembly comprising first and second side bases substantially parallel to one another, a header base substantially perpendicular to and interconnecting the first and second side bases, and extensions. A door is arranged within a space defined by the first and second side bases and the header base of the partially preassembled split doorjamb assembly so that the door, the first and second side bases, and the header base collectively establish a cavity. The extensions include first and second extensions and a header extension that are connectable lengthwise to the first and second side bases and the header base, respectively, removably secured adjacent to outer surfaces of the bases.

A sixth aspect of the invention provides a method of installing a door unit shipped in kit form. The door unit shipped in kit form includes a partially preassembled split doorjamb assembly including first and second side bases substantially parallel to one another, a header base substantially perpendicular to and interconnecting the first and second side bases, and extensions, and a door arranged within a space defined by the first and second side bases and the header base of the partially preassembled split doorjamb assembly so that the door, the first and second side bases, and the header base collectively establish a cavity. The extensions include first and second side extensions and a header extension that are connectable lengthwise to the first and second side bases and the header base, respectively, and are removably secured adjacent to outer surfaces of the bases. The partially preassembled split doorjamb assembly is inserted into and secured to an opening of a wall doorframe. The first side extension, the second extension, and the header extension are secured lengthwise to the first side base, the second side base, and the header base, respectively, in order to provide a completed doorframe that spans the width or thickness of the wall opening.

A seventh aspect of the invention provides a door unit in kit form including a partially preassembled split doorjamb assembly that includes first and second side bases substantially parallel to one another and a header base substantially perpendicular to and interconnecting the first and second side bases, and a door arranged within a space defined by the first and second side bases and the header base of the partially preassembled split doorjamb assembly so that the door, the first and second side bases, and the header base collectively establish a cavity. The partially preassembled split doorjamb assembly further includes extensions comprising first and second side extensions and a header extension that are movably connected to and secured adjacent to outer surfaces of the first and second side bases and the header base, respectively.

An eighth aspect of the invention provides a method of packaging a door unit in kit form. The method involved providing a partially preassembled split doorjamb assembly including first and second side bases substantially parallel to one another and a header base substantially perpendicular to and interconnecting the first and second side bases, the partially preassembled split doorjamb assembly further including first and second side extensions and a header extension that are movably connected to the first and second side bases and the header base, respectively. A door is arranged within a space defined by the first and second side bases and the header base of the partially preassembled split doorjamb assembly so that the door, the first and second side bases, and the header base collectively establish a cavity. The first and second side extensions and the header extension are arranged adjacent to outer surfaces of the first and second side bases and the header base, respectively.

A ninth aspect of the invention provides a method of installing a door shipped in kit form. The door unit shipped in kit form includes a partially preassembled split doorjamb assembly including first and second side bases substantially parallel to one another and a header base substantially perpendicular to and interconnecting the first and second side bases, a door arranged within a space defined by the first and second side bases and the header base of the partially preassembled split doorjamb assembly so that the door, the first and second side bases, and the header base collectively establish a cavity, and first and second side extensions and a header extension that are movably connected to and secured adjacent to outer surfaces of the first and second side bases and the header base, respectively. The extensions are unsecured from the outer surfaces of the bases, the partially preassembled split doorjamb assembly is inserted into an opening of a wall doorframe, and the partially preassembled doorjamb assembly is secured to the wall doorframe.

Aspects and exemplary aspects, embodiments and methods described herein are particularly advantageous for and applicable to door packaging, transportation, and installation, especially pre-hung doors.

Other aspects of the invention, including kits, assemblies, subassemblies, door units, processes, and the like which constitute part of the invention, will become more apparent upon reading the following detailed description of the exemplary embodiments.

BRIEF DESCRIPTION OF THE DRAWING(S)

The accompanying drawings are incorporated in and constitute a part of the specification. The drawings, together with the general description given above and the detailed description of the exemplary embodiments and methods given below, serve to explain the principles of the invention. In such drawings.

DETAILED DESCRIPTION OF EXEMPLARY EMBODIMENTS AND EXEMPLARY METHODS

Figure 1:
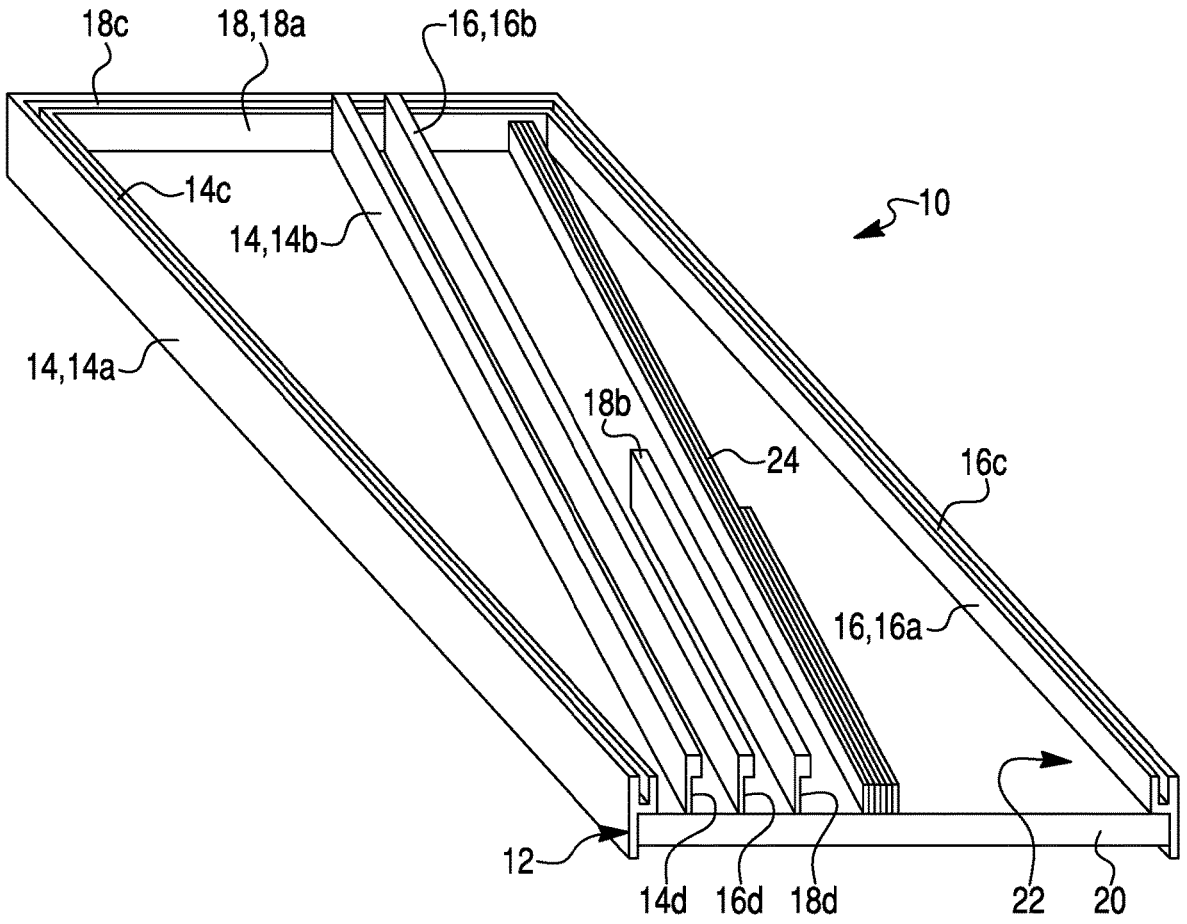
FIG. 1 is a bottom perspective view of a door kit according to an embodiment of the invention.

Reference will now be made in detail to exemplary embodiments and methods of the invention as illustrated in the accompanying drawings, in which like reference characters designate like or corresponding parts throughout the drawings. It should be noted, however, that the invention in its broader aspects is not necessarily limited to the specific details, representative materials and methods, and illustrative examples shown and described in connection with the exemplary embodiments and methods. Like reference characters refer to like parts throughout the drawings.

An exemplary pre-hung door unit in kit form is generally designated by reference numeral 10 in FIG. 1, and is also referred to herein as a door kit 10. In its illustrated form, the exemplary door kit 10 is a pre-hung door unit in kit form that can be assembled into a door unit for or during installation into a framed opening, such as a framed opening of a wall of a residential or commercial building.

The door kit 10 includes a "split" jamb assembly generally designated by reference numeral 12 in a partially preassembled state. The split jamb assembly 12 includes a first split side jamb 14, a second split side jamb 16, and a split header 18. The first split side jamb 14 includes a first side base 14*a* and a first side extension 14*b* that are separable and connectable to one another lengthwise. The second split side jamb 16 includes a second side base 16*a* and a second side extension 16*b* that are separable and connectable to one another lengthwise. The split header 18 includes a header base 18*a* and a header extension 18*b* that are separable and connectable to one another lengthwise.

The split jamb assembly 12 is partially preassembled for packaging and transportation, for example, to a retail or wholesale store or an installation site. As shown in FIG. 1, when the split jamb assembly 12 is in the partially preassembled state, such as for packaging and/or shipping, the first and second side bases 14*a* and 16*a* are spaced apart from one another and are substantially parallel to one another. The header base 18*a* extends between and interconnects respective top end portions of the first and second side bases 14*a* and 16*a* to one another. The header base 18*a* is substantially perpendicular to the first and second side bases 14*a* and 16*a*. By "substantially," it is understood that the bases 14*a*, 16*a*, and 18*a* may be subject to plumbing and shimming during installment to fit the building doorframe. Manufacturing, packaging, and installation tolerances that may cause the first and second side bases 14*a* and 16*a* to be not exactly parallel to one another and cause the header base 18*a* to be not exactly perpendicular to the first and second side bases 14*a* and 16*a* are not unexpected.

Any suitable fastener, adhesive, sealant, or other adjoining mechanism(s) and/or chemical(s) may be used to connect the header base 18*a* to the first and second side bases 14*a* and 16*a*. For example, L-shaped brackets and screws or nails (not shown) may be used to establish the connections of the partially preassembled split jamb assembly 12.

Although not shown, the partially preassembled split jamb assembly 12 may also include a sill, which optionally may be a split sill including a sill base and a sill extension. The sill, if provided, typically is substantially perpendicular to the first and second side bases 14*a* and 16*a* and interconnects respective bottom end portions of the first side base 14*a* and the second side base 16*a* to one another.

As also shown in FIG. 1, the door kit 10 further includes a door 20 having a rectangular shape. The door 20 is preferably an entryway door or interior door movable between an open position for providing a passageway between rooms and a closed position for separating rooms from one another. As packaged and transported, the door 20 is received within a space provided by the bases 14*a*, 16*a*, and 18*a* of the partially preassembled split jamb assembly 12. The door 20 preferably is pre-hung, such as by using one, two, three, or more hinges to connect a first side edge of the door 20 to the first side base 14*a*. Optionally, an opposite second side edge of the door 20 may include a lockset that engages a strike plate and/or opening of the second side base 16*a*.

As best shown in FIG. 1, the thickness of the door 20 is less than the width of the first and second side bases 14*a* and 16*a* and the header base 18*a*. Consequently, a cavity 22 bounded around its perimeter by the bases 14*a*, 16*a*, and 18*a*, bounded at one side by the door 20, and bounded at the opposite side by packaging such as a plastic wrap enclosure 26 (FIG. 3) is established. As discussed in further detail below, the cavity 22 provides space for storage of the first and second side extensions 14*b* and 16*b*, the header extension 18*b*, and other trim parts 24, such as brick molding, during packaging, transportation, and storage of the door kit 10.

Figure 2:
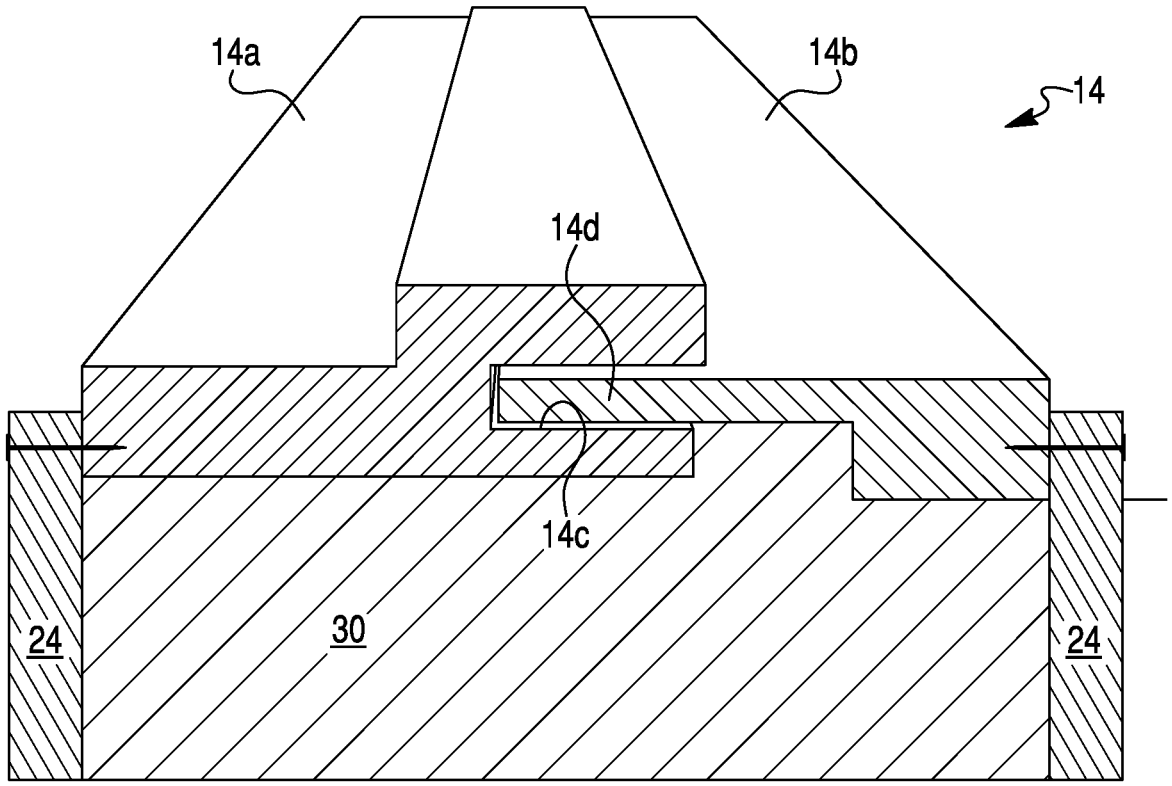
FIG. 2 is a cross-sectional perspective end view of a split side jamb and door trim of the door unit of FIG. 1 installed in a wall doorframe according to another embodiment of the invention.

The first and second side bases 14*a* and 16*a* and the header base 18*a* include respective grooves 14*c*, 16*c*, and 18*c* that align with one another about the perimeter of the partially assembled split jamb assembly 12. The first and second side extensions 14*b* and 16*b* and the header extension 18*b* include respective tongues 14*d*, 16*d*, and 18*d* that are receivable in the grooves 14*c*, 16*c*, and 18*c*, respectively. As shown in FIG. 1, in the kit form the extensions 14*b*, 16*b*, and 18*b* are in an unassembled state relative to the bases 14*a*, 16*a*, and 18*a*, so that the tongues 14*d*, 16*d*, and 18*d* are not inserted into the grooves 14*c*, 16*c*, and 18*c*, respectively. As best shown in FIG. 2, the tongue 14*d* is inserted into the grooves 14*c* after the door unit in kit form 10 has been delivered to its destination (e.g., building site) and unpackaged for installation. Likewise, the tongues 16*d* and 18*d* are inserted into the grooves 16*c* and 18*c*, respectively, in the same manner as shown in FIG. 2 after the door unit in kit form 10 has been delivered to its destination and unpackaged for installation. Optionally, the tongues 14*d*, 16*d*, and 18*d* have widths slightly less than the width of the openings of the grooves 14*c*, 16*c*, and 18*c*, respectively, to establish frictionally mated tongue-in-groove connections. Brackets, fasteners, adhesives, sealants, and/or other adjoining mechanism(s) and/or chemical(s) may be employed to connect and/or secure the extensions 14*b*, 16*b*, and 18*b* to the bases 14*a*, 16*a*, and 18*a*, respectively. Although not shown, it should be understood that reversing the tongues and grooves is possible, so that the bases 14*a*, 16*a*, and 18*a* are provided with the tongues, and the extensions 14*b*, 16*b*, and 18*b* are provided with the grooves.

As best shown in FIG. 1, the first and second side bases 14*a* and 16*a* and the header base 18*a* each include a protruding part that forms one side of the grooves 14*c*, 16*c*, and 18*c*. The protruding part acts as a jamb doorstop. In FIG. 1, for example, the door 20 abuts against the jamb doorstop protruding part of the bases 14*a*, 16*a*, and 18*a* to prevent pass through of the door 20 and possible resulting damage to the hinges.

As indicated above, the split jamb assembly 12 of the door kit 10 is partially preassembled for packaging and transportation to a delivery site (e.g., a retailer, wholesaler, or installation site). The first and second side extensions 14*b* and 16*b* and the header extension 18*b* of the door kit 10 are not preassembled with the first and second side bases 14*a* and 16*a* and the header base 18*a*, respectively. The extensions 14*b*, 16*b*, and 18*b* and other trim parts (e.g., brick molding) 24, as well as brackets, fasteners, and/or adhesive, are stowed in the cavity 22 during packaging and retained in the cavity 22 during shipping and preferably until unpacking for installation at the installation site. As best shown in FIG. 1, because the first and second side extensions 14*b* and 16*b* are about the same length as the first and second side bases 14*a* and 16*a*, the first and second side extensions 14*b* and 16*b* are stowed within the cavity 22 diagonally, i.e., at an oblique angle relative to the first and second side bases 14*a* and 16*a*. The header extension 18*b* and additional trim parts 24 are likewise stowed within the cavity 22 for packaging and transportation. Packaging the first split side jamb 14, the second split side jamb 16, and the split header 18 in their unassembled states reduces the overall thickness of the split jamb assembly 12 and the door kit 10 as a whole for transportation and storage.

An enclosure 26 is placed around the partially preassembly split jamb assembly 12 and the stowed extensions 14*b*, 16*b*, and 18*b* and other trim parts 24. In an exemplary embodiment shown in FIG. 3, the enclosure 26 is a plastic wrap or seal, desirably is a transparent material such as a plastic sheath wrapped around the door kit 10 for packaging purposes and having sufficient strength to withstand shipping and handling during transportation without tearing the plastic wrapping/sheath. Part of the enclosure 26 faces the side of the door 20 against which the extensions 14*b*, 16*b*, and 18*b* are stowed to establish a side of the cavity 22 and retain the extensions 14*b*, 16*b*, and 18*b* in the cavity 22 for safe transport. The plastic wrapping/sheath enclosure 26 may be stapled, tied, strapped, banded, tightly wrapped, or otherwise secured about the door kit 10, and thus may be easily removed at the place of installation. Alternatively, the enclosure 26 may be a shipping container, such as a cardboard box.

The first and second split side jambs 14 and 16, the split header 18, and the additional trim parts 24 made be made of the same materials as one another or may be made of different materials. Similarly, the bases 14*a*, 16*a*, 18*a* may be made of the same material or different materials than the extensions 14*b*, 16*b*, and 18*b*. Suitable materials include wood, metal such as steel, plastics, and wood composites. Fire resistant materials are especially useful. Various types of materials may be used for making the door 20, such as wood doors, composite doors, fiber-reinforced doors, steel doors, etc. The door 20 may be solid core or hollow core.

Stowing the extensions 14*b*, 16*b*, and 18*b* and other parts (e.g., the trim parts 24, fasteners, adhesive, lockset, strike plate, etc.) that do not form part of the partially preassembled split jamb assembly 12 within the cavity 22 provides several advantages. The overall thickness of the door kit 10 is significantly reduced, thereby simplifying shipping and substantially reducing storage space requirements for transport and inventory. The stowing of the extensions 14*b*, 16*b*, and 18*b* and other parts within the cavity 22 also reduces instances of accidental loss of the unassembled parts. Further, the door 20 can be pre-hung to the partially preassembled split jamb assembly 12 of the door kit 10 by one, two, three, or more hinges connecting the door 20 to one of the side bases 14*a* or 16*a*, so that installation is simplified.

A method of packaging the door kit 10 will now be described in greater detail. The partially preassembled split jamb assembly 12 including the first and second side bases 14*a* and 16*a* substantially parallel to one another and the header base 18*a* substantially perpendicular to and interconnecting the first and second side bases 14*a* and 16*a* is provided. Fasteners, adhesives, sealants, and/or other adjoining mechanism(s) and/or chemical(s) may be used to connect the bases 14*a*, 16*a*, and 18*a* to one another and form the partially preassembled split jamb assembly 12. Optionally, a sill or sill base may be included in the partially preassembled split jamb assembly. The door 20 is arranged within a space defined by the first and second side bases 14*a* and 16*a* and the header base 18*a* of the partially preassembled split jamb assembly 12 so that the door 20, the first and second side bases 14*a* and 16*a*, and the header base 18*a* collectively establish the cavity 22. The extensions 14*b*, 16*b*, and 18*b* are stowed in the cavity 22 so that the first and second side extensions 14*b* and 16*b* and the header extension 18*b* are unassembled with respect to one another, yet removable from the cavity 22 so as to be connected lengthwise to the first and second side bases 14*a* and 16*a* and the header base 18*a*, respectively. A packaging material, such as the plastic wrap enclosure 26, may be wrapped around the partially preassembled split jamb assembly 12 to establish a side of the cavity 22 opposite to the door 20, and thereby retain the extensions 14*b*, 16*b*, and 18*b* and other parts in the cavity 22. Optionally, the extensions 14*b*, 16*b*, and 18*b* may be secured to the partially preassembled split jamb assembly 12 and/or the door 20 using tape, staples, ties, straps, bands, and/or other temporary fasteners. Additionally or alternatively, the packaging material may press against the edges of the extensions 14*b*, 16*b*, and 18*b* and other trim parts 24 opposite to the door 20 surface to secure the extensions 14*b*, 16*b*, and 18*b* and trim parts 24 in place.

The packaging method may be accomplished using additional or fewer steps. Also, the steps may be performed in various sequences.

A method of installing the door kit 10 into a wall opening to establish a door unit in the wall opening will now be described in greater detail. After the packaging material 26 is removed, the extensions 14*b*, 16*b*, and 18*b*, the trim parts 24, and other stowed parts (e.g., fasteners, adhesive, etc.) are removed from the cavity 22. The partially preassembled split jamb assembly 12 is inserted into an opening of a wall doorframe 30. Standard fasteners, adhesive, sealant, and/or other mechanical mechanisms and/or chemicals may be employed to secure the bases 14*a*, 16*a*, and 18*a* to the sides and top of the wall doorframe 30. Plumbing and/or shimming may also be performed to properly align the partially preassembled split jamb assembly 12. The first side extension 14*b* is connected lengthwise to the first side base 14*a*, the second side extension 16*b* is connected lengthwise to the second side base 16*a*, and the header extension 18*b* is connected lengthwise to the header base 18*a*. For example, the tongues 14*d*, 16*d*, and 18*d* may be inserted into the grooves 14*c*, 16*c*, and 18*c*, respectively. The tongue-and-groove connections may involve frictional mating of parts. Brackets, fasteners, and/or adhesive may be employed to connect the extensions 14*b*, 16*b*, and 18*b* to the bases 14*a*, 16*a*, and 18*a*, respectively. Optionally, trim 24 is then attached to the first split side jamb 14, the second split side jamb 16, and the split header 18. In FIG. 2, the trim 24 in the form of brick molding is connected by fasteners such as nails or screws, adhesive, and/or sealant to the first side base 14*a* on one side of the wall doorframe 30 and to the first side extension 14*b* on the other side of the wall doorframe 30. Trim 24 may similarly be connected to the wall doorframe 30 with respect to the second split side jamb 16 and the split header 18.

The installation method may be accomplished using additional or fewer steps. Also, the steps may be performed in various sequences other than the sequence described above. For example, the split jamb assembly 12 may be secured to the wall doorframe 30 before or after the extensions 14*b*, 16*b*, and 18*b* are connected to the base 14*a*, 16*a*, and 18*a*, respectively.

Figure 3:
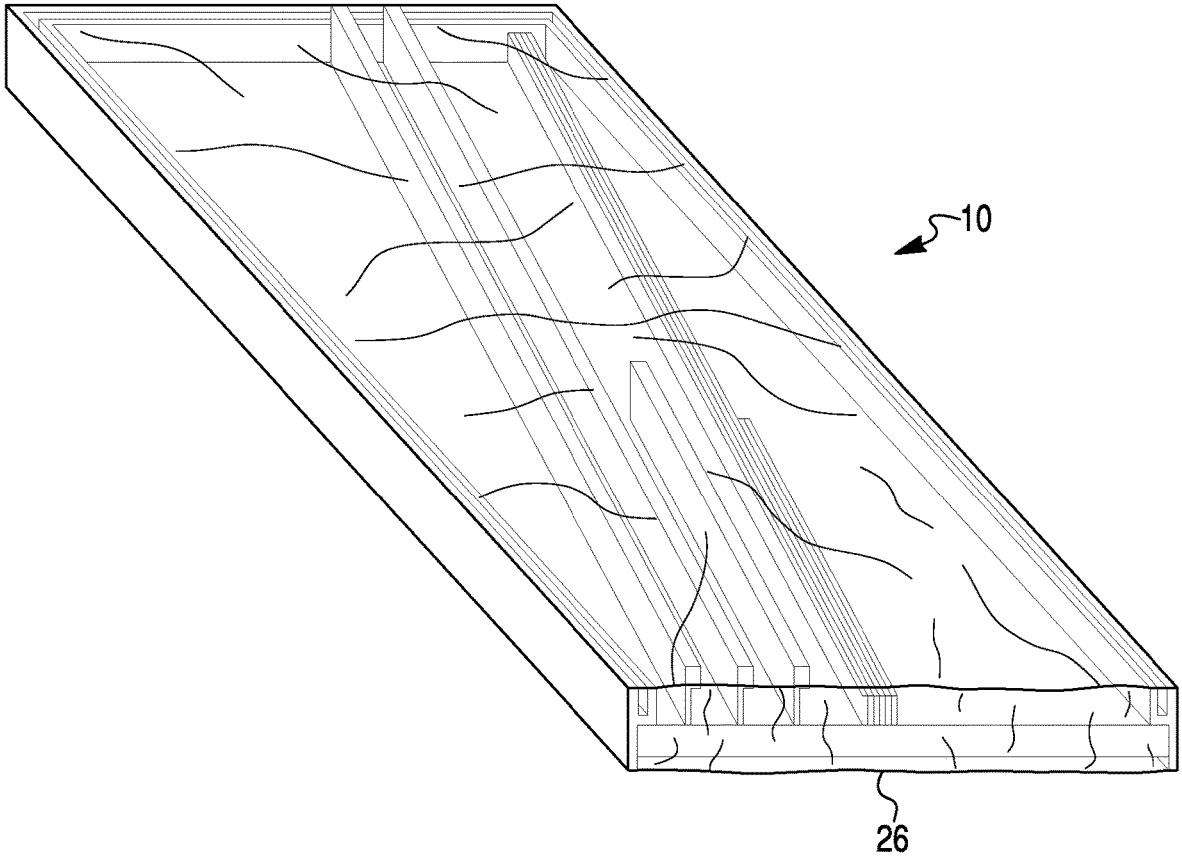
FIG. 3 is bottom perspective view of the door kit of FIG. 1 with an enclosure in the form of a plastic wrap.

Another exemplary pre-hung door unit in kit form will now be described with reference to FIGS. 4-6. Comparable parts to those of the first embodiment illustrated in FIGS. 1-3 are designated with like reference numerals with the addition of a one-hundred digit. For example, the pre-hung door unit in kit form is generally designated by reference numeral 110 in FIG. 4, and is also referred to herein as a door kit 110. In its illustrated form, the exemplary door kit 110 is a pre-hung door unit in kit form that can be assembled into a door unit for or during installation into a framed opening, such as a framed opening of a wall of a residential or commercial building.

The door kit 110 includes a "split" jamb assembly generally designated by reference numeral 112 in a partially preassembled state. The split jamb assembly 112 includes a first split side jamb 114, a second split side jamb 116, and a split header 118. The first split side jamb 114 includes a first side base 114*a* and a first side extension 114*b* that are separable and connectable to one another lengthwise. The second split side jamb 116 includes a second side base 116*a* and a second side extension 116*b* that are separable and connectable to one another lengthwise. The split header 118 includes a header base 118*a* and a header extension 118*b* that are separable and connectable to one another lengthwise. In FIG. 4, the header extension 118*b* is hidden behind the header base 118*a*, and is better shown in FIG. 5.

The split jamb assembly 112 is partially preassembled for packaging and transportation, for example, to a retail or wholesale store or an installation site. As shown in FIGS. 4 and 5, when the split jamb assembly 112 is in the partially preassembled state, such as for packaging and/or shipping, the first and second side bases 114*a* and 116*a* are spaced apart from one another and are substantially parallel to one another. The header base 118*a* extends between and interconnects respective top end portions of the first and second side bases 114*a* and 116*a* to one another. The header base 118*a* is substantially perpendicular to the first and second side bases 114*a* and 116*a*. By "substantially," it is understood that the bases 114*a*, 116*a*, and 118*a* may not be exactly 90 degrees, because the split jamb assembly 112 may be subject to plumbing and shimming during installment to fit the building doorframe. Manufacturing, packaging, and installation tolerances that may cause the first and second side bases 114*a* and 116*a* to be not exactly parallel to one another and cause the header base 118*a* to be not exactly perpendicular to the first and second side bases 114*a* and 116*a* are not unexpected.

Any suitable fastener, adhesive, sealant, or other adjoining mechanism(s) and/or chemical(s) may be used to connect the header base 118*a* to the first and second side bases 114*a* and 116*a*. For example, L-shaped brackets and screws or nails (not shown) may be used to establish the connections of the partially preassembled split jamb assembly 112.

Although not shown, the partially preassembled split jamb assembly 112 may also include a sill, which optionally may be a split sill including a sill base and a sill extension. The sill, if provided, typically is substantially perpendicular to the first and second side bases 114*a* and 116*a* and interconnects respective bottom end portions of the first side base 114*a* and the second side base 116*a* to one another.

Figure 4:
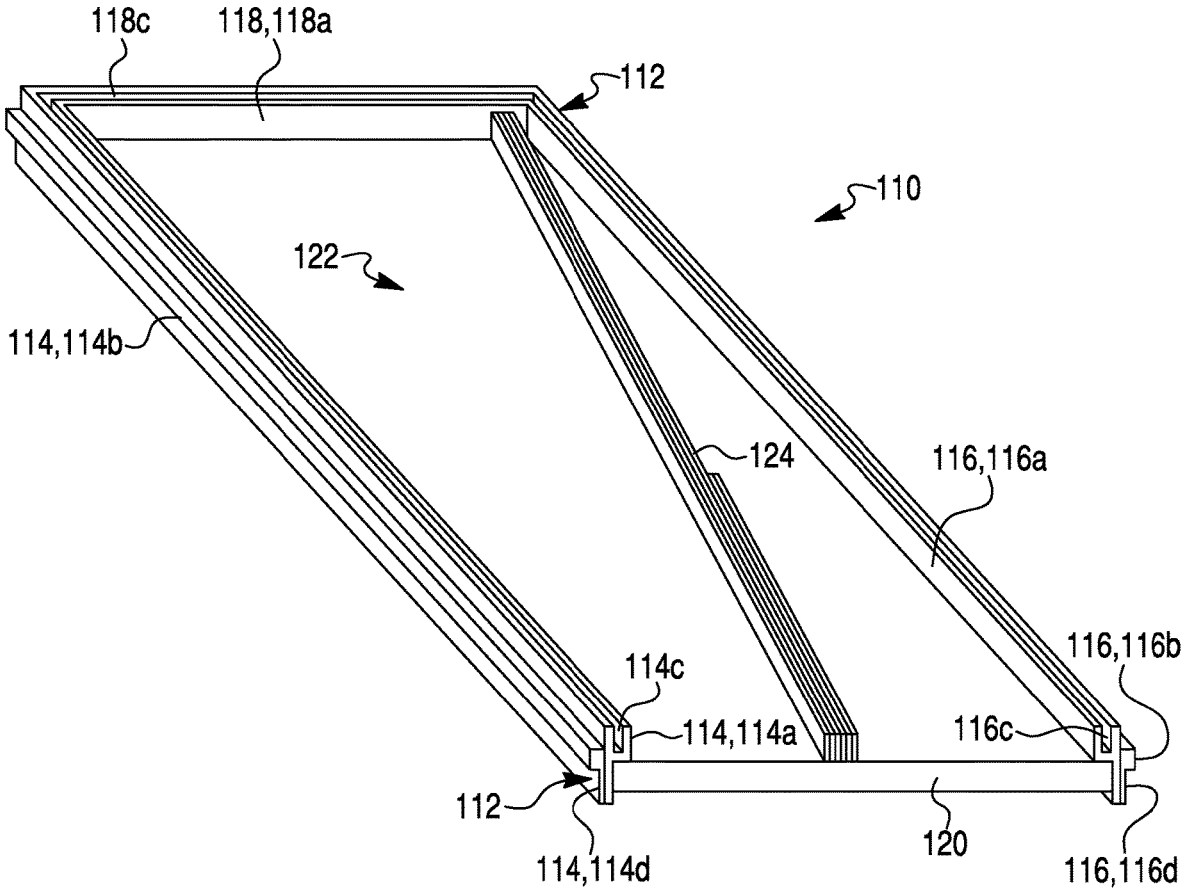
FIG. 4 is a bottom perspective view of a door kit according to another embodiment of the invention.
Figure 5:
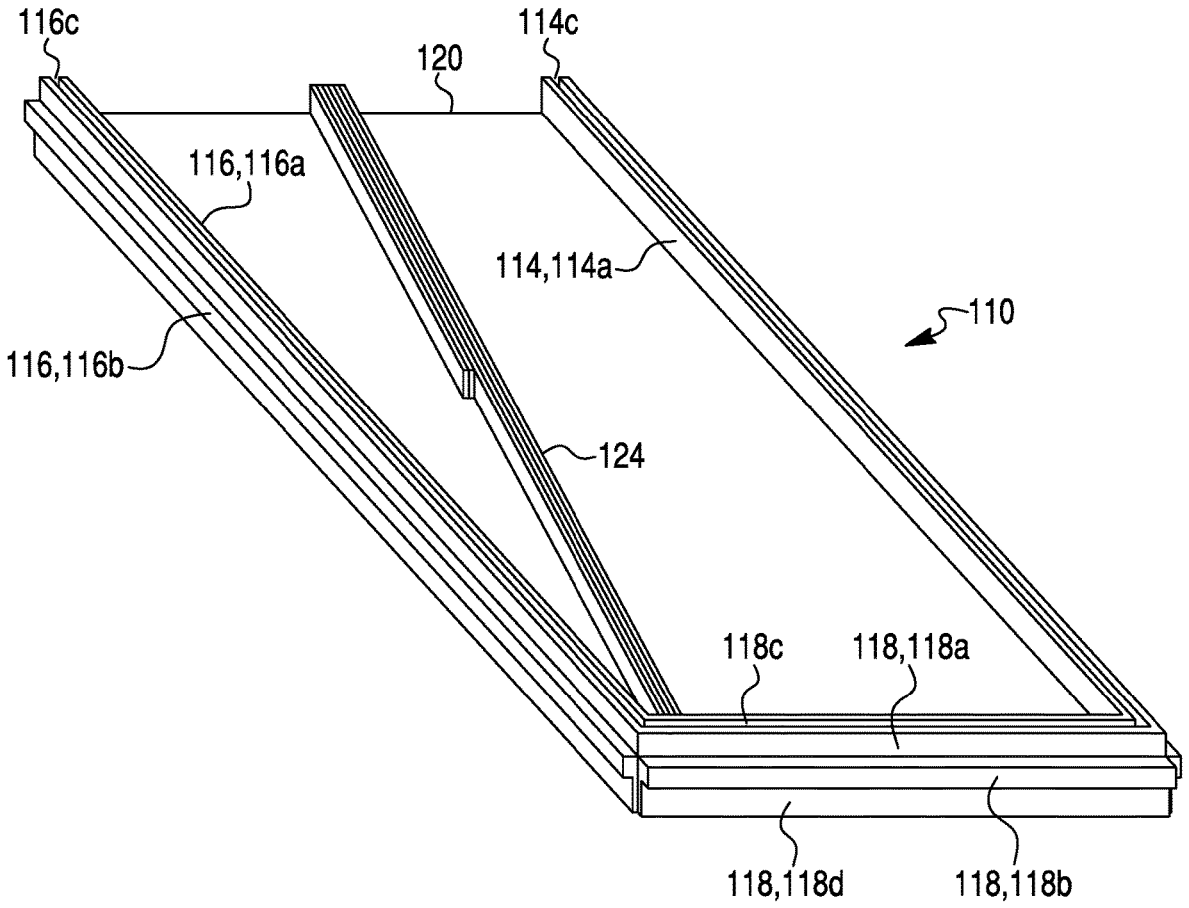
FIG. 5 is a top perspective view of the door kit of FIG. 4.

As also shown in FIGS. 4 and 5, the door kit 110 further includes a door 120 having a rectangular shape. The door 120 is preferably an entryway door or interior door movable between an open position for providing a passageway between rooms and a closed position for separating rooms from one another. As packaged and transported, the door 120 is received within a space provided by the bases 114*a*, 116*a*, and 118*a* of the partially preassembled split jamb assembly 112. The door 120 preferably is pre-hung, such as by using one, two, three, or more hinges to connect a first side edge of the door 120 to the first side base 114*a*. Optionally, an opposite second side edge of the door 120 may include a lockset that engages a strike plate and/or opening of the second side base 116*a*.

As best shown in FIGS. 4 and 5, the thickness of the door 120 is less than the width of the first and second side bases 114*a* and 116*a* and the header base 118*a*. Consequently, a cavity 122 bounded around its perimeter by the bases 114*a*, 116*a*, and 118*a*, bounded at one side by the door 120, and bounded at the opposite side by packaging such as a plastic wrap or other enclosure 126 (FIG. 6) is established. As discussed in further detail below, the cavity 122 provides space for storage of trim parts 124, such as brick molding, as well as brackets, fasteners, and/or adhesive, during packaging, transportation, and storage of the door kit 110.

The first and second side bases 114*a* and 116*a* and the header base 118*a* include respective grooves 114*c*, 116*c*, and 118*c* that align with one another about the perimeter of the partially assembled split jamb assembly 112. The first and second side extensions 114*b* and 116*b* and the header extension 118*b* include respective tongues 114*d*, 116*d*, and 118*d* that are receivable in the grooves 114*c*, 116*c*, and 118*c*, respectively, in the same manner as shown in FIG. 2 and described above in connection with the first exemplary embodiment. The tongue 118*d* of the header extension 118*b* is hidden in FIG. 4 behind the header base 118*a*, and is better shown in FIG. 5. In the door kit 110 in its unassembled state, the tongues 114*d*, 116*d*, and 118*d* are not inserted into the grooves 114*c*, 116*c*, and 118*c*, i.e., the extensions 114*b*, 116*b*, and 118*b* are unassembled relative to the bases 114*a*, 116*a*, and 118*a*. To assemble the extensions 114*b*, 116*b*, and 118*b* relative to their bases 114*a*, 116*a*, and 118*a*, the tongues 114*d*, 116*d*, and 118*d* are inserted into the grooves 114*c*, 116*c*, and 118*c*, respectively, after the door unit in kit form 110 has been delivered to its destination (e.g., building site) and unpackaged for installation. Optionally, the tongues 114*d*, 116*d*, and 118*d* have widths slightly less than the width of the openings of the grooves 114*c*, 116*c*, and 118*c*, respectively, to establish frictionally mated tongue-in-groove connections. Brackets, fasteners, adhesives, sealants, and/or other adjoining mechanism(s) and/or chemical(s) may be employed to connect and/or secure the extensions 114*b*, 116*b*, and 118*b* in an assembled state to the bases 114*a*, 116*a*, and 118*a*, respectively. Although not shown, it should be understood that reversing the tongues and grooves is possible, so that the bases 114*a*, 116*a*, and 118*a* are provided with the tongues, and the extensions 114*b*, 116*b*, and 118*b* are provided with the grooves.

As indicated above, the split jamb assembly 112 of the door kit 110 is partially preassembled for packaging and transportation to a delivery site (e.g., a retailer, wholesaler, or installation site). The first and second side extensions 114*b* and 116*b* and the header extension 118*b* of the door kit 110 are not preassembled with the first and second side bases 114*a* and 116*a* and the header base 118*a*, respectively. The extensions 114*b*, 116*b*, and 118*b* are removably secured to outer surfaces of the bases 114*a*, 116*a*, and 118*a* for shipping and preferably until unpacking for installation at the installation site. Packaging the first split side jamb 114, the second split side jamb 116, and the split header 118 in their unassembled states reduces the overall thickness of the split jamb assembly 112 and the door kit 110 as a whole for transportation and storage.

An enclosure 126 is placed around the partially preassembly split jamb assembly 112 and the extensions 114*b*, 116*b*, and 118*b* and other trim parts 124. In an exemplary embodiment, the enclosure 126 is a plastic wrap or seal, desirably is a transparent material such as a plastic sheath wrapped around the door kit 110 for packaging purposes and having sufficient strength to withstand shipping and handling during transportation without tearing the plastic wrapping/sheath. Part of the enclosure 126 faces the side of the door 120 against which the trim parts 124 are stowed to establish a side of the cavity 122 and retain the trim parts 124 in the cavity 122 for safe transport. Alternatively, the enclosure 126 may be a shipping container, such as a cardboard box.

The extensions 114*b*, 116*b*, and 118*b* may be secured adjacent to the outer surface of the bases 114*a*, 116*a*, and 118*a*, respectively, using temporary fasteners, such as staples, tape, ties, adhesive, etc. Additionally or alternatively, the enclosure 126, particularly plastic wrap, around the edges of the door kit 110 may secure the extensions 114*b*, 116*b*, and 118*b* to the bases 114*a*, 116*a*, and 118*a*. The plastic wrapping/sheath enclosure 126 may be stapled, tied, or otherwise secured about the door kit 110, and thus may be easily removed at the place of installation. Preferably, the extensions 114*b*, 116*b*, and 118*b* are placed in direct contact with the outer surfaces of the bases 114*a*, 116*a*, and 118*a*. Optionally, a protective sheet such as foam or cardboard may be interposed between the extensions 114*b*, 116*b*, and 118*b* and the outer surfaces of the bases 114*a*, 116*a*, and 118*a* to protect the adjacent surfaces from scuffing and marring.

The first and second split side jambs 114 and 116, the split header 118, and the additional trim parts 124 made be made of the same materials as one another or may be made of different materials. Similarly, the bases 114*a*, 116*a*, 118*a* may be made of the same material or different materials than the extensions 114*b*, 116*b*, and 118*b*. Suitable materials include wood, metal such as steel, plastics, and wood composites. Fire resistant materials are especially useful. Various types of materials may be used for making the door 120, such as wood doors, composite doors, fiber-reinforced doors, steel doors, etc. The door 120 may be solid core or hollow core.

Removably securing the extensions 114*b*, 116*b*, and 118*b* to outer surfaces of the bases 114*a*, 116*a*, and 118*a* and stowing other parts (e.g., the trim parts 124, fasteners, adhesive, lockset, strike plate, etc.) that do not form part of the partially preassembled split jamb assembly 112 within the cavity 122 provides several advantages. The overall thickness of the door kit 110 is significantly reduced (compared to the extensions assembled with respect to the bases), thereby simplifying shipping and substantially reducing storage space requirements for transport and inventory. The securing of the extensions 114*b*, 116*b*, and 118*b* adjacent to the outer surfaces of the bases 114*a*, 116*a*, and 118*a* and the stowing of other parts 124 within the cavity 122 also reduces instances of accidental loss of the unassembled parts. Further, the door 120 can be pre-hung to the partially preassembled split jamb assembly 112 of the door kit 110 by hinges connecting the door 120 to one of the side bases 114*a* or 116*a*, so that installation is simplified.

A method of packaging the door kit 110 will now be described in greater detail. The partially preassembled split jamb assembly 112 including the first and second side bases 114*a* and 116*a* substantially parallel to one another and the header base 118*a* substantially perpendicular to and interconnecting the first and second side bases 114*a* and 116*a* is provided. Fasteners, adhesives, sealants, and/or other adjoining mechanism(s) and/or chemical(s) may be used to connect the bases 114*a*, 116*a*, and 118*a* to one another and form the partially preassembled split jamb assembly 112. Optionally, a sill or sill base may be included in the partially preassembled split jamb assembly 112. The door 120 is arranged within a space defined by the first and second side bases 114*a* and 116*a* and the header base 118*a* of the partially preassembled split jamb assembly 112 so that the door 120, the first and second side bases 114*a* and 116*a*, and the header base 118*a* collectively establish the cavity 122. The extensions 114*b*, 116*b*, and 118*b* are removably secured adjacent to outer surfaces of the bases 114*a*, 116*a*, and 118*a* so that the first and second side extensions 114*b* and 116*b* and the header extension 118*b* are unassembled with respect to the bases.

Figure 6:
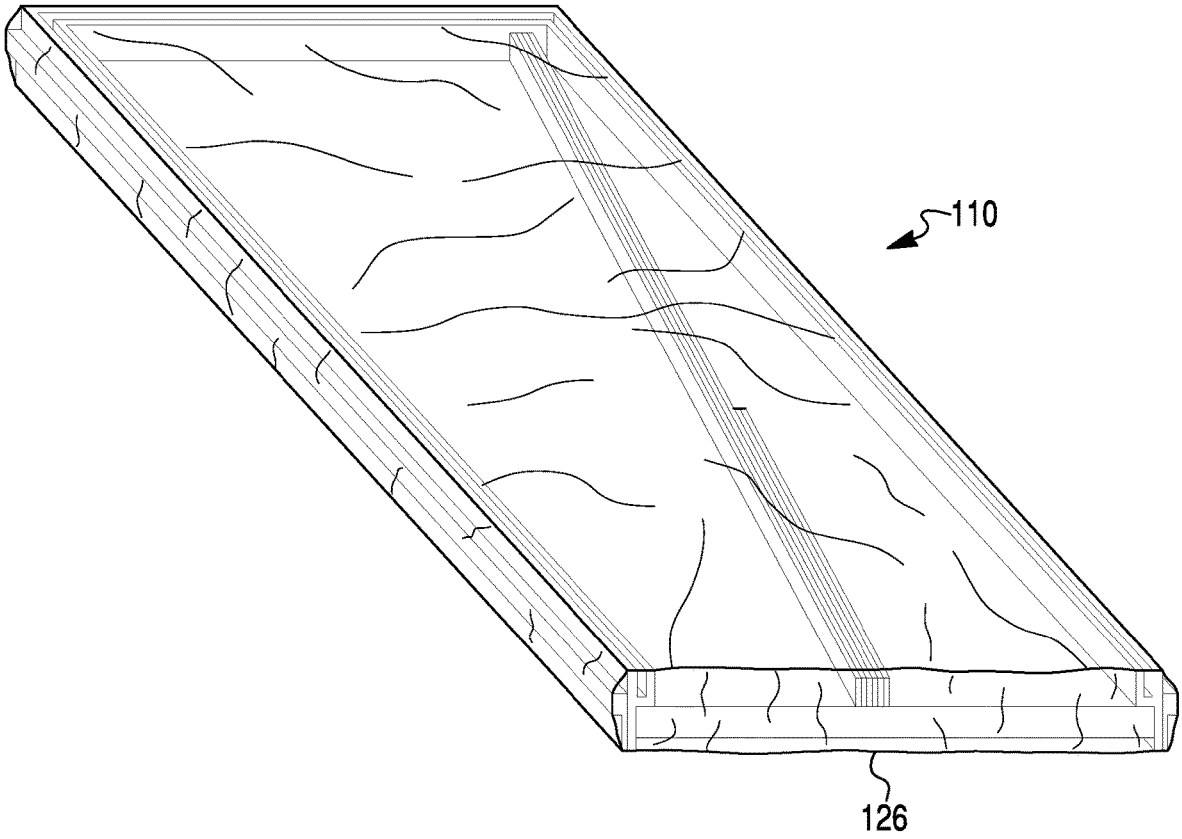
FIG. 6 is a bottom perspective view of the door kit of FIG. 4 with an enclosure in the form of a plastic wrap.

As best shown in FIG. 6, the packaging material 126, such as plastic wrap, may be wrapped around the partially preassembled split jamb assembly 112 to establish a side of the cavity 122 opposite to the door 120, and thereby retain the trim parts 124 in the cavity 122. The packaging material 126 may also serve to removably secure the extensions 114*b*, 116*b*, and 118*b* to the outer surfaces of the bases 114*a*, 116*a*, and 118*a*, respectively. That is, the packaging material 126 may press against the outer surfaces of the extensions 114*b*, 116*b*, and 118*b* and other trim parts 124 opposite to the door 20 surface to removably secure the extensions and trim parts in place. Additionally or alternatively, tape, staples, ties, straps, bands, and/or other temporary fasteners may be used to temporarily secure the extensions 114*b*, 116*b*, and 118*b* adjacent to the bases 114*a*, 116*a*, and 118*a*, respectively, and to removably secure the trim parts 124 against the door 120 in the cavity 122.

The packaging method may be accomplished using additional or fewer steps. Also, the steps may be performed in various sequences.

A method of installing the door kit 110 into a wall opening to establish a door unit in the wall opening will now be described in greater detail. After the packaging material/enclosure 126 is removed, the extensions 114*b*, 116*b*, and 118*b*, the trim parts 124, and other stowed parts (e.g., fasteners, adhesive, etc.) are separated from the bases 114*a*, 116*a*, and 118*a* and removed from the cavity 122. The partially preassembled split jamb assembly 112 is inserted into an opening of a wall doorframe 30 (FIG. 3) in the same manner described above in connection with the first embodiment and FIG. 2. Standard fasteners, adhesive, sealant, and/or other mechanical mechanisms and/or chemicals may be employed to secure the bases 114*a*, 116*a*, and 118*a* to the wall doorframe 30. Plumbing and/or shimming may also be performed to properly align the partially preassembled split jamb assembly 112. The first side extension 114*b* is connected lengthwise to the first side base 114*a*, the second side extension 116*b* is connected lengthwise to the second side base 116*a*, and the header extension 118*b* is connected lengthwise to the header base 118*a*. For example, the tongues 114*d*, 116*d*, and 118*d* may be inserted into the grooves 114*c*, 116*c*, and 118*c*, respectively. The tongue-and-groove connections may involve frictional mating of parts. Brackets, fasteners, and/or adhesive may be employed to connect the extensions 114*b*, 116*b*, and 118*b* to the bases 114*a*, 116*a*, and 118*a*, respectively. Optionally, trim 124 is then attached to the first split side jamb 114, the second split side jamb 116, and the split header 118. The trim 124 in the form of brick molding is connected by fasteners such as nails or screws, adhesive, and/or sealant to the first side base 114*a* on one side of the wall doorframe 30 and to the first side extension 114*b* on the other side of the wall doorframe 30 in a manner similar to that shown in FIG. 3.

The installation method may be accomplished using additional or fewer steps. Also, the steps may be performed in various sequences other than the sequence described above. For example, the split jamb assembly 112 may be secured to the wall doorframe 30 before or after the extensions 114*b*, 116*b*, and 118*b* are connected in an assembled state to the base 114*a*, 116*a*, and 118*a*, respectively.

Another exemplary pre-hung door unit in kit form will now be described with reference to FIGS. 7-10. Comparable parts to those of the second embodiment illustrated in FIGS. 4-6 are designated with like reference numerals with the addition of a two-hundred digit. For example, the pre-hung door unit in kit form is generally designated by reference numeral 210 in FIG. 10, and is also referred to herein as a door kit 210. In its illustrated form, the exemplary door kit 210 is a pre-hung door unit in kit form that can be assembled into a door unit for or during installation into a framed opening, such as a framed opening of a wall of a residential or commercial building.

The door kit 210 includes a "split" jamb assembly generally designated by reference numeral 212 in a partially preassembled state. The split jamb assembly 212 includes a first split side jamb 214, a second split side jamb 216, and a split header 218. The first split side jamb 214 includes a first side base 214*a* and a first side extension 214*b* that are connected to one another lengthwise by at least one first joint member, such as a hinge, 214*c*. The second split side jamb 216 includes a second side base 216*a* and a second side extension 216*b* that are connected to one another lengthwise by at least one second joint member 216*c*. The split header 218 includes a header base 218*a* and a header extension 218*b* that connected to one another lengthwise by at least one third joint member 218*c*.

Figure 8:
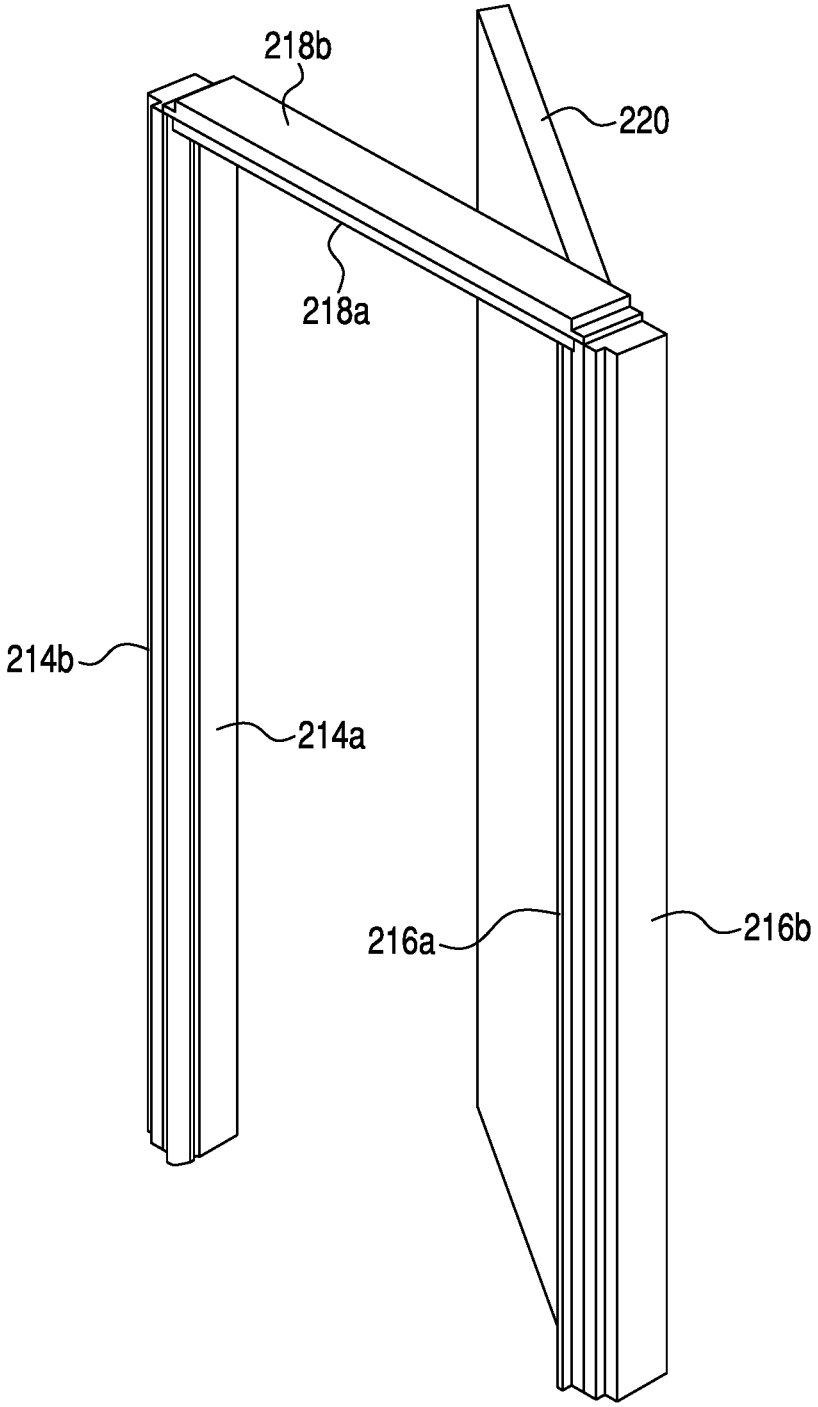
FIG. 8 is a front perspective view of the door kit of FIG. 7 in a folded state.

The split jamb assembly 212 is partially preassembled for packaging and transportation, for example, to a retail or wholesale store or an installation site. As shown in FIG. 8, when the split jamb assembly 212 is in the partially preassembled state, such as for packaging and/or shipping, the first and second side bases 214*a* and 216*a* are spaced apart from one another and are substantially parallel to one another. The header base 218*a* extends between and interconnects respective top end portions of the first and second side bases 214*a* and 216*a* to one another. The header base 218*a* is substantially perpendicular to the first and second side bases 214*a* and 216*a*. By "substantially," it is understood that the bases 214*a*, 216*a*, and 218*a* may not be exactly 90 degrees, because the split jamb assembly 212 may be subject to plumbing and shimming during installment to fit the building doorframe. Manufacturing, packaging, and installation tolerances that may cause the first and second side bases 214*a* and 216*a* to be not exactly parallel to one another and cause the header base 218*a* to be not exactly perpendicular to the first and second side bases 214*a* and 216*a* are not unexpected.

Although not shown, the partially preassembled split jamb assembly 212 may also include a sill, which optionally may be a split sill including a sill base and a sill extension. The sill, if provided, typically is substantially perpendicular to the first and second side bases 214*a* and 216*a* and interconnects respective bottom end portions of the first side base 214*a* and the second side base 216*a* to one another.

Figure 7:
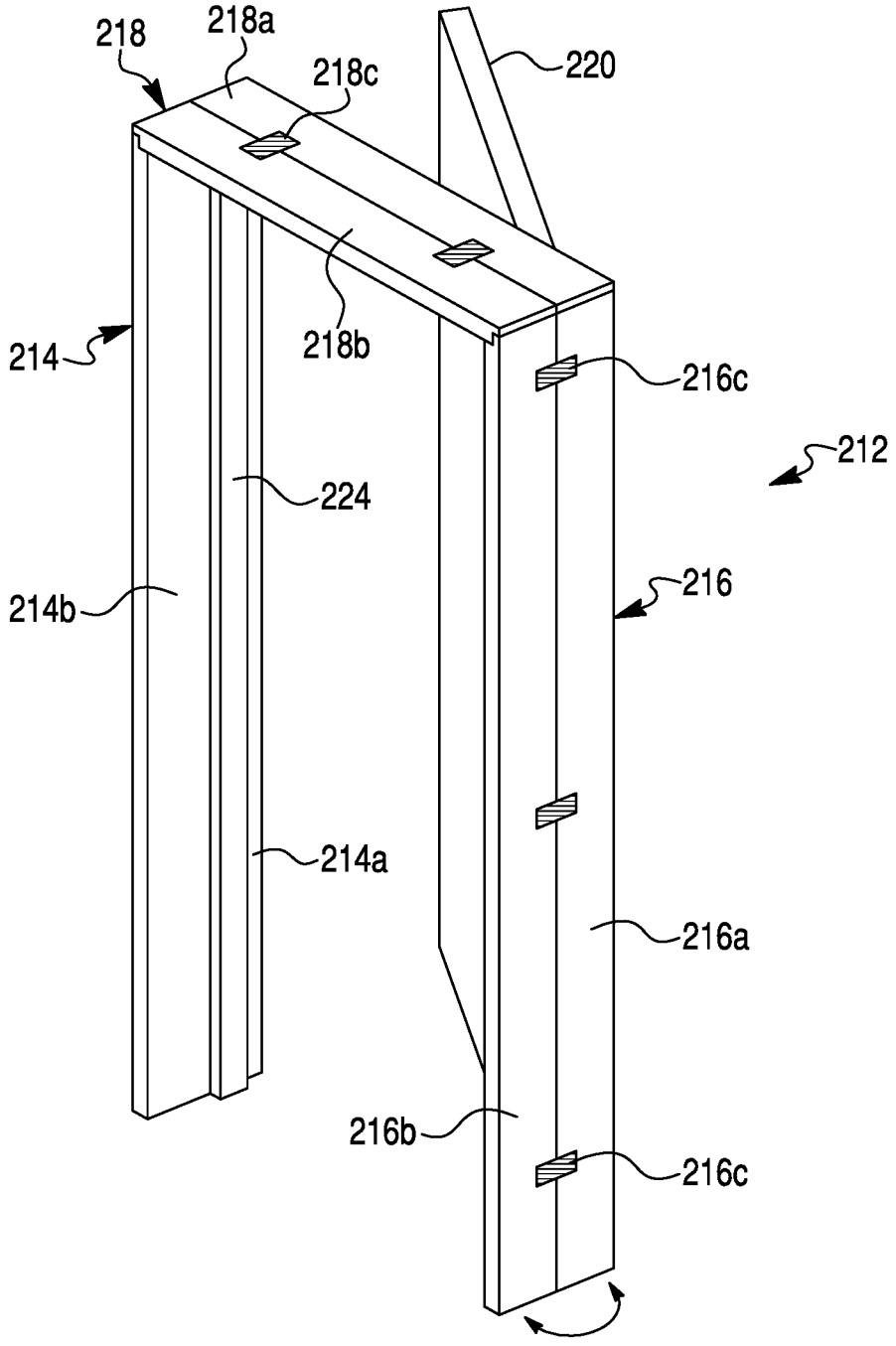
FIG. 7 is a front perspective view of a door kit in an extended or deployed state according to still another embodiment of the invention.

As also shown in FIGS. 7 and 8, the door kit 210 further includes a door 220 having a rectangular shape. The door 220 is preferably an entryway door or interior door movable between an open position for providing a passageway between rooms and a closed position for separating rooms from one another. As packaged and transported, the door 220 is received within a space provided by the bases 214*a*, 216*a*, and 218*a* of the partially preassembled split jamb assembly 212. The door 220 preferably is pre-hung, such as by using one, two, three, or more hinges to connect a side edge of the door 220 to the second side base 216*a*. Optionally, an opposite side edge of the door 220 may include a lockset that engages a strike plate and/or opening of the first side base 216*b*.

Figure 10:
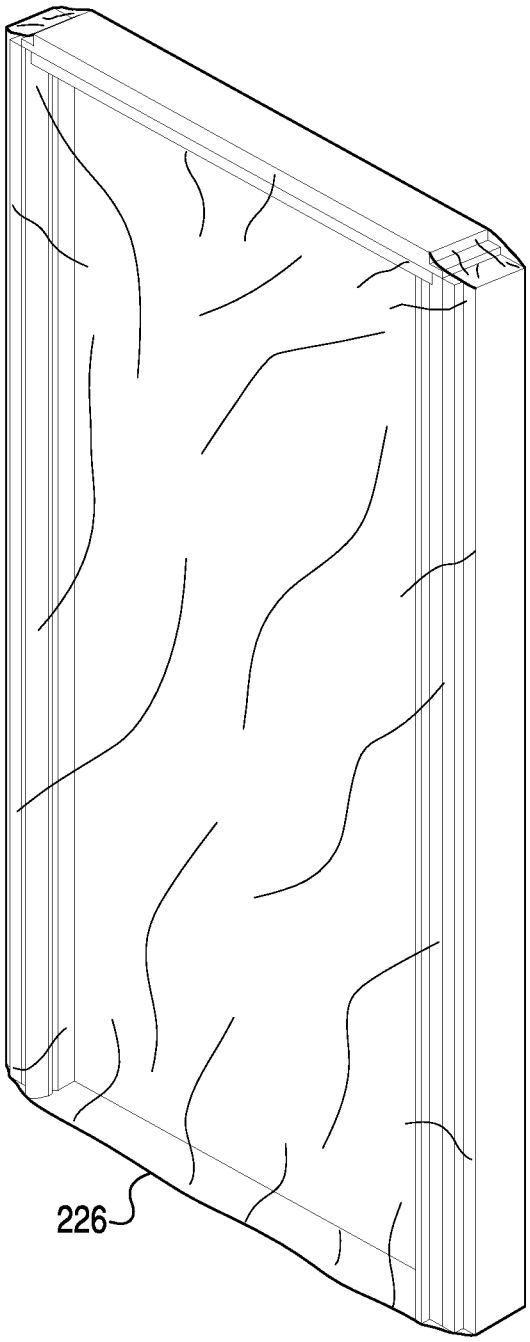
FIG. 10 is a bottom perspective view of the door kit of FIG. 8 in the folded state with an enclosure in the form of a plastic wrap.

As best shown in FIG. 10, the thickness of the door 220 is less than the width of the first and second side bases 214*a* and 216*a* and the header base 218*a*. Consequently, a cavity 222 bounded around its perimeter by the bases 214*a*, 216*a*, and 218*a*, bounded at one side by the door 220, and bounded at the opposite side by packaging such as a plastic wrap enclosure 226 is established. As discussed in further detail below, the cavity 222 provides space for storage of trim parts 224, such as brick molding and jamb doorstops, as well as brackets, fasteners, and/or adhesive, during packaging, transportation, and storage of the door kit 210.

As indicated above, joint members (e.g., hinges) 214*c*, 216*c*, and 218*c* movably (e.g, pivotally) connect the extensions 214*b*, 216*b*, and 218*b* to the side bases 214*a*, 216*a*, and 218*a*, respectively, for permitting movement of the extensions 214*b*, 216*b*, and 218*b* between an extended (or deployed) position shown in FIG. 7 and a stowed position shown in FIG. 8. In the extended (or deployed) position, the extensions 214*b*, 216*b*, and 218*b* are edge-to-edge and having outer surface that are coplanar with the side bases 214*a*, 216*a*, and 218*a*, respectively. In the stowed position, outer surfaces of the extensions 214*b*, 216*b*, and 218*b* and positioned adjacent to outer surfaces of the side bases 214*a*, 216*a*, and 218*a*. The stowed position is preferred for packaging and transportation of the door kit 210 to a delivery site (e.g., a retailer, wholesaler, or installation site). Packaging the first split side jamb 214, the second split side jamb 216, and the split header 218 in their stowed state reduces the overall thickness of the split jamb assembly 212 and the door kit 210 as a whole for transportation and storage.

The joint member (e.g., hinges) 214*c*, 216*c*, and 218*c* may be a thin resilient material, such as a strap, bendable metal strip, or a tape, connecting the extensions 214*b*, 216*b*, and 218*b* to the side bases 214*a*, 216*a*, and 218*a*, respectively. The hinges 214*c*, 216*c*, and 218*c* alternatively may be a conventional mechanical hinge, such as a bi-fold metal hinge. The extensions 214*b*, 216*b*, and 218*b* may be secured to their corresponding side bases 214*a*, 216*a*, and 218*a* via interlocking mechanisms, such as snap locks, tongue-and-groove connections, and the like.

Figure 9:
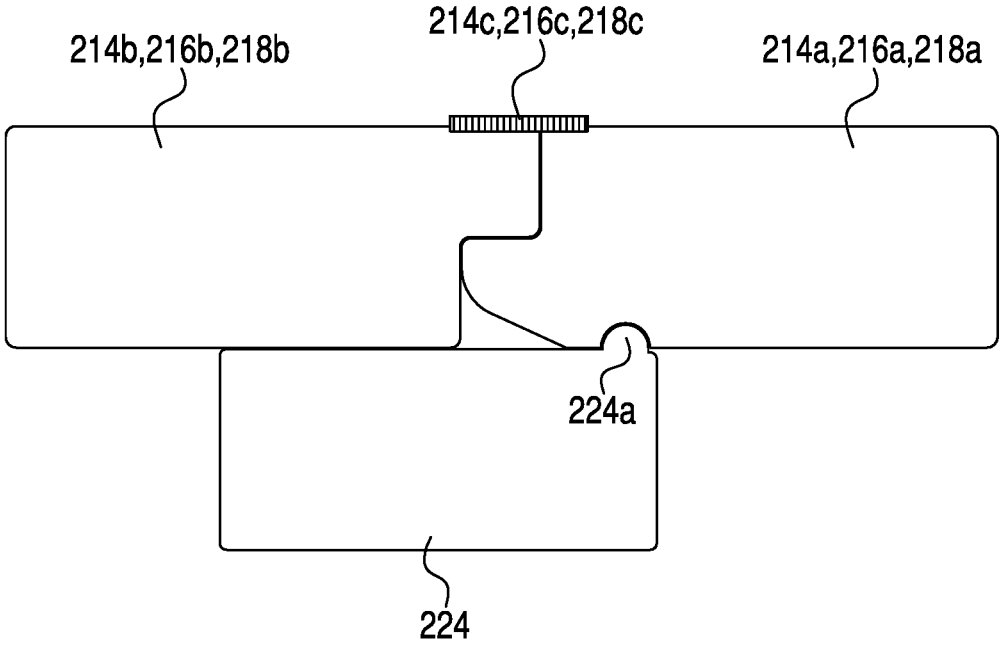
FIG. 9 is a partial cross-sectional view of the door kit in the extended or deployed state.

Referring to FIG. 9, the first split side jamb 214, the second split side jamb 216, and the split header 218 may be provided with respective jamb doorstops 224 as separate trim pieces. The jamb doorstops 224 prevent the door 220 from swinging through the split jamb assembly 212 and damaging the doorjamb hinges (not shown). The jamb doorstops 224 include a bump 224*a* that mates into a corresponding groove of the side bases 214*a*, 216*a*, and 218*a* for fitting and optionally attachment purposes. The mating of the bump 224*a* to the groove may involve a frictional fit.

An enclosure 226 is placed around the partially preassembly split jamb assembly 212 and the extensions 214*b*, 216*b*, and 218*b* and other trim parts 224. In an exemplary embodiment, the enclosure 226 is a plastic wrap or seal, desirably is a transparent material such as a plastic sheath wrapped around the door kit 210 for packaging purposes and having sufficient strength to withstand shipping and handling during transportation without tearing the plastic wrapping/sheath. Part of the enclosure 226 faces the side of the door 220 against which the trim parts 224 are stowed to establish a side of the cavity 222 and retain the trim parts 224 in the cavity 222 for safe transport. Alternatively, the enclosure 226 may be a shipping container, such as a cardboard box.

The extensions 214*b*, 216*b*, and 218*b* in their stowed positions may be secured adjacent to the outer surface of the side bases 214*a*, 216*a*, and 218*a*, respectively, using temporary fasteners, such as staples, tape, ties, adhesive, etc. Additionally or alternatively, the enclosure 226 is wrapped around the edges of the door kit 210 to secure the extensions 214*b*, 216*b*, and 218*b* in the stowed positions. The plastic wrapping/sheath enclosure 226 may be stapled, tied, wrapped, or otherwise secured about the door kit 210, and thus may be easily removed at the place of installation. Preferably, outer surfaces of the extensions 214*b*, 216*b*, and 218*b* are placed in direct contact with the outer surfaces of the bases 214*a*, 216*a*, and 218*a*. Optionally, a protective sheet such as foam or cardboard may be interposed between the outer surfaces of the extensions 214*b*, 216*b*, and 218*b* and the outer surfaces of the bases 214*a*, 216*a*, and 218*a* to protect the adjacent surfaces from scuffing and marring.

The first and second split side jambs 214 and 216, the split header 218, and the additional trim parts 224 made be made of the same materials as one another or may be made of different materials. Similarly, the bases 214*a*, 216*a*, 218*a* may be made of the same material or different materials than the extensions 214*b*, 216*b*, and 218*b*. Suitable materials include wood, metal such as steel, plastics, and wood composites. Fire resistant materials are especially useful. Various types of materials may be used for making the door 220, such as wood doors, composite doors, fiber-reinforced doors, steel doors, etc. The door 220 may be solid core or hollow core.

Arranging the extensions 214*b*, 216*b*, and 218*b* in their stowed positions adjacent to outer surfaces of the bases 214*a*, 216*a*, and 218*a* and stowing other parts (e.g., jamb doorstops and other trim parts 224, fasteners, adhesive, lockset, strike plate, etc.) within the cavity 222 provides several advantages. The overall thickness of the door kit 210 is significantly reduced (compared to the extensions assembled with respect to the bases), thereby simplifying shipping and substantially reducing storage space requirements for transport and inventory. The securing of the extensions 214*b*, 216*b*, and 218*b* adjacent to the outer surfaces of the bases 214*a*, 216*a*, and 218*a* and the stowing of other parts 224 within the cavity 222 also reduces instances of accidental loss of the unassembled parts. Further, the door 220 can be pre-hung to the partially preassembled split jamb assembly 212 of the door kit 210 by one or typically two, three, or more hinges connecting the door 220 to one of the side bases 214*a* or 216*a*, so that installation is simplified.

A method of packaging the door kit 210 will now be described in greater detail. The partially preassembled split jamb assembly 212 including the first and second side bases 214*a* and 216*a* substantially parallel to one another and the header base 218*a* substantially perpendicular to and interconnecting the first and second side bases 214*a* and 216*a* is provided. Fasteners, adhesives, sealants, and/or other adjoining mechanism(s) and/or chemical(s) may be used to connect the bases 214*a*, 216*a*, and 218*a* to one another and form the partially preassembled split jamb assembly 212. For packaging, the door 220 is arranged within a space defined by the first and second side bases 214*a* and 216*a* and the header base 218*a* of the partially preassembled split jamb assembly 212 so that the door 220, the first and second side bases 214*a* and 216*a*, and the header base 218*a* collectively establish the cavity 222. The extensions 214*b*, 216*b*, and 218*b* are moved into the stowed positions and their outer surfaces are secured adjacent to outer surfaces of the bases 214*a*, 216*a*, and 218*a*. The packaging material 226, such as plastic wrap, may be wrapped around the partially preassembled split jamb assembly 212 to establish a side of the cavity 222 opposite to the door 220, and thereby retain the trim parts 224 in the cavity 222. The packaging material 226 may also serve to further secure the extensions 214*b*, 216*b*, and 218*b* in place relative to the bases 214*a*, 216*a*, and 218*a*, respectively.

To install the door kit 210 into a wall opening, the packaging material/enclosure 226 is removed, the extensions 214*b*, 216*b*, and 218*b* are moved from their stowed position to their extended or deployed positions relative to the side bases 114*a*, 116*a*, and 118*a*, respectively. The split jamb assembly 112 is inserted into an opening of a wall doorframe 30 in the same manner described above in connection with the first embodiment and FIG. 2. Standard fasteners, adhesive, sealant, and/or other mechanical mechanisms and/or chemicals may be employed to secure the bases 214*a*, 216*a*, and 218*a* to the wall doorframe 30. Plumbing and/or shimming may also be performed to properly align the partially preassembled split jamb assembly 212. Optionally, the trim 224 is then attached to the first split side jamb 214, the second split side jamb 216, and the split header 218. Trim in the form of brick molding is connected by fasteners such as nails or screws, adhesive, and/or sealant to the first side base 214*a* on one side of the wall doorframe 30 (FIG. 2) and to the first side extension 214*b* on the other side of the wall doorframe 30.

The packaging and installation methods may be accomplished using additional or fewer steps. Also, the steps may be performed in various sequences.

The structures, methods, and other features of the embodiments described above may be combined with one another and modified by persons skilled in the art having reference to this disclosure.

The enclosures 26, 126, 226 described herein may be made of packaging films such a polyvinylchloride (PVC), polystyrene (PS), polyethylene (PE), polyethylene terephthalate (PET), low density polyethylene (LDPE), and high density polyethylene (HDPE), all preferably +/−0.5 mil thick. An exemplary commercial enclosure material is U25112 Unisource Defiance VMC Stretch Film 30X9000FT 50GA LLDPE CST MG C1S 20/SK. Other enclosure materials that may be used include metal (e.g., steel) banding/strapping (e.g., 0.014 to 0.025 inch thick), polyphenylene ether, and corrugated cardboard.

Although the above exemplary embodiments have been described in connection with door kits and door units, a person of ordinary skill in the art having reference to this disclosure will understand that the principles described herein may be applied to a window kits and window unit.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed.

What is claimed is:

1. A method of packaging a door unit in kit form, comprising the steps of:

providing a partially preassembled split doorjamb assembly comprising first and second side bases substantially parallel to one another and a header base substantially perpendicular to and interconnecting the first and second side bases, the partially preassembled split doorjamb assembly further comprising first and second extensions and a header extension that are unassembled with respect to and connectable lengthwise to the first and second side bases and the header base, respectively;

arranging a door within a space defined by the first and second side bases and the header base of the partially preassembled split doorjamb assembly so that the door, the first and second side bases, and the header base collectively establish a cavity; and stowing the first and second side extensions and a header extension in the cavity.

2. The method of claim 1, further comprising pre-hanging the door to the first side base.

3. The method of claim 1, wherein said stowing comprises arranging the first and second side extensions in the cavity at an oblique angle relative to the first and second side bases.

4. The method of claim 1, wherein said stowing comprises arranging trim parts of the door unit in kit form in the cavity with the first and second side extensions and the header extension.

5. The method of claim 1, wherein the first side base and the first side extension, the second side base and the second side extension, and the header base and the header extension are connectable to one another lengthwise by tongue-and-groove connections.

6. The method of claim 5, wherein the first side base, the second side base, and the header base comprises respective grooves, and wherein the first side extension, the second side extension, and the header extension comprise respective tongues receivable by the respective grooves.

7. The method of claim 1, further comprising enclosing the partially preassembled split door assembly and the door within an enclosure that defines a side of the cavity opposite to the door.

8. A method of installing a door unit shipped in kit form, comprising the steps of:

providing a door unit shipped in kit form comprising a partially preassembled split doorjamb assembly comprising first and second side bases substantially parallel to one another, a header base substantially perpendicular to and interconnecting the first and second side bases, and extensions;

a door arranged within a space defined by the first and second side bases and the header base of the partially preassembled split doorjamb assembly so that the door, the first and second side bases, and the header base collectively establish a cavity; and the extensions stowed within the cavity, the extensions comprising first and second side extensions and a header extension that are unassembled with respect to and connectable lengthwise to the first and second side bases and the header base, respectively;

removing the extensions from the cavity;

inserting the partially preassembled split doorjamb assembly into an opening of a wall doorframe;

securing the partially preassembled doorjamb assembly to the wall doorframe; and connecting lengthwise the first side extension to the first side base, the second side extension to the second side base, and the header extension to the header base.

9. The method of claim 8, wherein the door is pre-hung to the first side base.

10. The method of claim 8, wherein the first and second side extensions of the door unit shipped in kit form are arranged in the cavity at an oblique angle relative to the first and second side bases.

11. The method of claim 8, wherein the door unit shipped in kit form further comprises trim parts arranged in the cavity with the first and second side extensions and the header extension.

12. The method of claim 8, wherein the first side base and the first side extension, the second side base and the second side extension, and the header base and the header extension are connectable to one another lengthwise by tongue-and-groove connections.

13. The method of claim 12, wherein the first side base, the second side base, and the header base comprises respective grooves, and wherein the first side extension, the second side extension, and the header extension comprise respective tongues receivable by the respective grooves.

14. The method of claim 8, wherein said securing of the partially preassembled doorjamb assembly to the wall doorframe precedes said connecting lengthwise of the first side extension to the first side base, the second side extension to the second side base, and the header extension to the header base.

15. The method of claim 8, wherein said securing of the partially preassembled doorjamb assembly to the wall doorframe follows said connecting lengthwise of the first side extension to the first side base, the second side extension to the second side base, and the header extension to the header base.

16. The method of claim 8, wherein the door shipped in kit form further comprises an enclosure defining a side of the cavity opposite to the door.

17. A method of packaging a door unit in kit form, comprising the steps of:

providing a partially preassembled split doorjamb assembly comprising first and second side bases substantially parallel to one another and a header base substantially perpendicular to and interconnecting the first and second side bases, the partially preassembled split doorjamb assembly further comprising extensions comprising first and second side extensions and a header extension that are movably connected to the first and second side bases and the header base, respectively;

arranging a door within a space defined by the first and second side bases and the header base of the partially preassembled split doorjamb assembly so that the door, the first and second side bases, and the header base collectively establish a cavity; and arranging the first and second side extensions and the header extension adjacent to outer surfaces of the first and second side bases and the header base, respectively.

18. The method of claim 17, wherein the door is pre-hung to the first side base.

19. The method of claim 17, further comprising arranging trim parts in the cavity.

20. The method of claim 17, further comprising enclosing the partially preassembled split door assembly and the door with an enclosure to define a side of the cavity opposite to the door.

* * * * *